United States Patent [19]

Drake

[11] 4,227,694

[45] Oct. 14, 1980

[54] AIM-ASSISTING GOLF PUTTER

[76] Inventor: Robert C. Drake, 37971 Huron Pointe Dr., Mt. Clemens, Mich. 48045

[21] Appl. No.: 943,783

[22] Filed: Sep. 20, 1978

[51] Int. Cl.[3] ..... A63B 53/00

[52] U.S. Cl. ..... 273/164; 273/81.3; 273/80 C; 273/81 B; 273/81.4

[58] Field of Search ..... 273/167 K, 164, 163 R, 273/163 A, 167 G, 80 C, 81.3, 81.4, 81 B

[56] References Cited

U.S. PATENT DOCUMENTS

| | | | |
|---|---|---|---|
| D. 228,930 | 10/1973 | Leigh | 273/164 |
| 1,705,250 | 3/1929 | Hincks | 273/164 |
| 3,319,962 | 5/1967 | Summers | 273/81.3 X |
| 3,341,203 | 9/1967 | Brill | 273/80 C X |

FOREIGN PATENT DOCUMENTS

| | | | |
|---|---|---|---|
| 465643 | 5/1937 | United Kingdom | 273/164 |

*Primary Examiner*—George J. Marlo
*Attorney, Agent, or Firm*—Willis Bugbee

[57] ABSTRACT

Immediately above the connection at the center of the head of this golf putter to its shaft, the latter has a forwardly-extending elongated horizontal primary lower aiming portion perpendicular to the center of the forward face of the putter head. An upwardly-inclined intermediate secondary aiming portion of the shaft extends from the forward end of the lower aiming portion to the lower end of the handle-attached upper portion of the shaft which is approximately aligned with the rearward face of the putter head. The lower and intermediate shaft portions lie approximately in a vertical plane perpendicular to the forward face of the putter head and passing through the center of that forward face.

4 Claims, 7 Drawing Figures

AIM-ASSISTING GOLF PUTTER

BACKGROUND OF THE INVENTION

In the past, golf putters have been provided with grooves or aiming lines in the heads perpendicular to the face thereof in the effort to enable the golfer to better aim the ball toward the cup. Because of the small width of the putter, however, the consequent shortness of the grooves or aiming lines limits their usefulness in aiming the putter to propel the ball to the cup. Another putter has been provided with a shaft having its upper portion curved in arcuate form in the effort to improve aiming, but this expedient places the aiming portion of the shaft too far from the head, consequently decreasing the accuracy of the aim. Some putters have previously been provided with horizontal handles at the top of the shaft for use in aligning the putter with the intended path of the ball to the cup, but these require the golfer to straddle the ball on opposite sides of it and then to swing the putter in an arcuate path between his legs. Moreover, such a straddling stance of the golfer in putting is presently prohibited by rules. Another previous putter placed the forward face of the head and a sidewise bent portion of the shaft in the same plane with the putter shaft connected to and rising from one end of the head, so that the lower portion of the shaft lay in a plane perpendicular to the line of trajectory of the putter head and ball toward the cup. This prior putter, however, had only a thin blade as a head, with a correspondingly short aiming lines.

SUMMARY OF THE INVENTION

The invention principally resides in the provision of a putter having a shaft with an elongated forwardly-extending substantially horizontal sighting or aiming portion projecting forward from its connection with the putter head, continuing in an upwardly-and-rearwardly-inclined intermediate shaft portion to an upper shaft portion approximately aligned with the rearward face of the putter head and with an elongated handle with a flat forward side and coaxial with the upper shaft portion. This enables the golfer to stand with the legally permissible stance with one foot behind and slightly to one side of the other foot and to swing the putter beside the forward foot and at the same time accurately aim the putter head by the forwardly-projecting aiming portions so as to hit the ball along a trajectory terminating at the cup.

Figures 1, 2, 3, 4, 5, 6, 7:
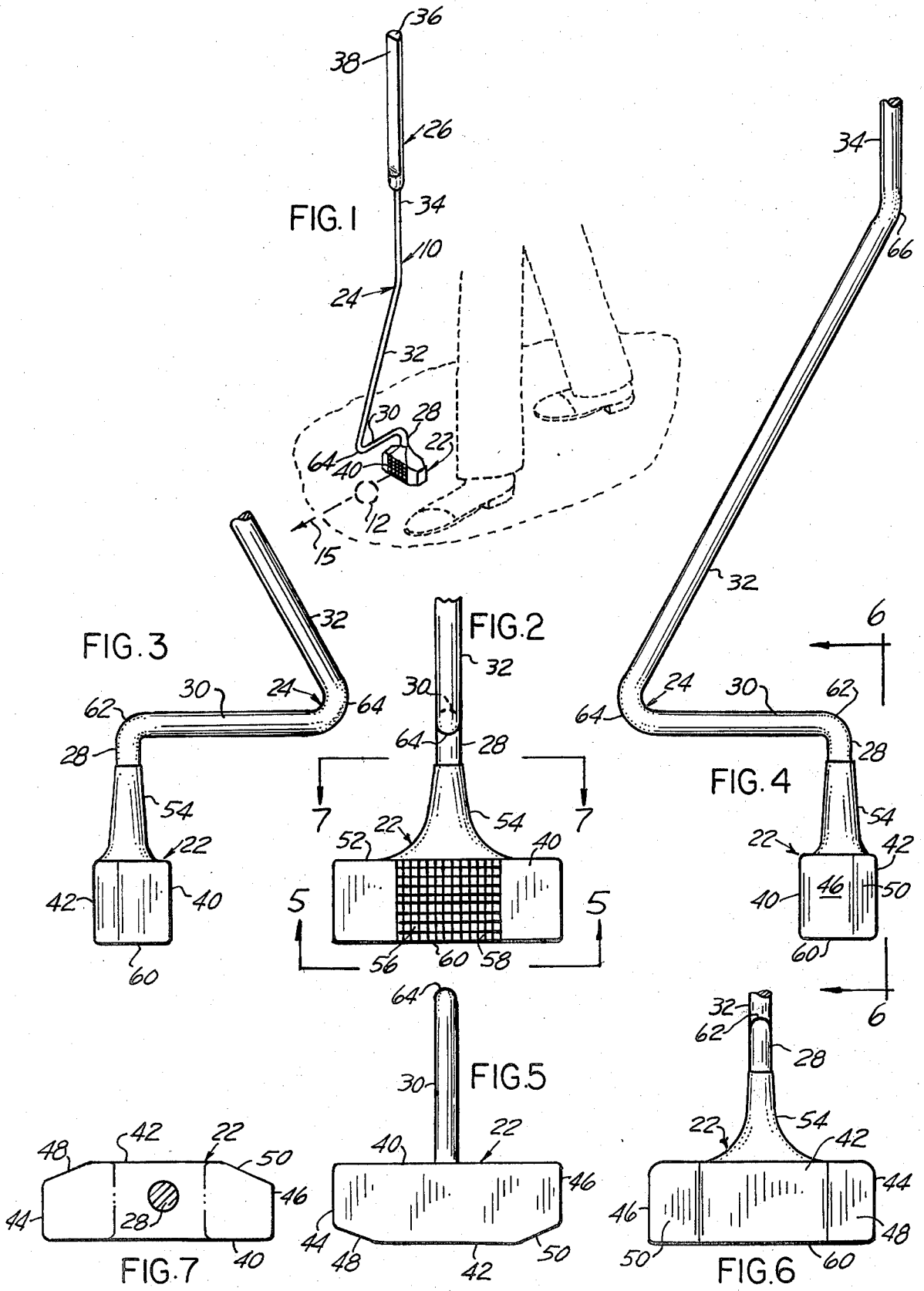
FIG. 1 is a perspective view, upon a reduced scale, of a preferred form of the putter according to the present invention shown in its position of use, with the ball and the golfer's stance shown in dotted lines.
FIG. 2 is a front elevation of the lower portion of the golf putter of FIG. 1, shown upon an enlarged scale.
FIG 3 is a right-hand side elevation of the putter head and lower and intermediate shaft portions shown in FIG. 1.
FIG. 4 is a left-hand side elevation of the putter head and lower and intermediate shaft portions shown in FIG. 1.
FIG. 5 is a bottom plan view looking in the direction of the arrows 5—5 in FIG. 2.
FIG. 6 is a rear elevation looking in the direction of the arrows 6—6 in FIG. 3.
FIG. 7 is a horizontal section looking downward along the line 7—7 in FIG. 2.

Referring to the drawing in detail, FIG. 1 shows an aim-assisting golf putter, generally designated 10, according to a preferred form of the invention in the middle of its stroke to propel a golf ball 12 along a trajectory 15 ending at the cup (not shown). Shown in dotted lines are the right and left legs 14 and 16 respectively of the golfer G with his right and left shoes 18 and 20 respectively in the preferred stance of the golfer G for putting. The putter 10 consists generally of an inverted vertical T-shaped head 22, a shaft 24, and a handle or hand grip 26, at the upper end of the shaft 24. The shaft 24 consists of a short lowermost approximately vertical head-connection portion 28, a substantially horizontal forwardly-extending lower primary aiming portion 30, an upwardly-inclined intermediate second aiming portion 32 and a substantially vertical upper portion 34 which is approximately aligned with the rearward face of the head 22 (FIG. 4). The upper shaft portion 34 continues upward within the handle or hand grip 26.

The handle 26 is sufficiently elongated to accommodate the clenched hands of the golfer G placed one above the other in the usual manner and its rearward side 36 is of approximately slightly greater than semicircular cross-section. Its forward side 38, however, is flattened to be approximately parallel to the front face 40 of the putter head 22 so as to assist the golfer G in pressing his thumbs against the flattened side 38 so as to rotate and place the front face 40 of the putter head 22 perpendicular to the line of sight or ball trajectory 15 with the cup.

The putter head 22, as previously stated, has a front face 40 and a rearward face 42 (FIGS. 2, 3 and 4) with opposite end faces 44 and 46 at its right-hand and left-hand sides respectively (FIG. 7). The rearward corners 48 and 50 (FIGS. 6 and 7) are cut away obliquely.

Rising slightly rearwardly of the center of the top 52 of the putter head 22 is a frusto-conical neck portion 54 (FIGS. 2, 3 and 4) which receives the lower portion 28 of the shaft 24 coaxial therewith. The central portion or impact portion 56 of the front face 40 is preferably cross-scored as at 58 to prevent lateral slippage of the ball 12 upon impact therewith. The putter head 22 has a bottom plate or sole 60 relatively to which the front face 40 is inclined slightly upward and rearward so as to possess a slight loft or backward slant of the front face 40 of the putter head 22.

The lowermost vertical portion 28 of the shaft 24 has a curved connection 62 with the forwardly-extending lower primary aiming portion 30 in such a manner as to cause the axes of the shaft portions 28 and 30 to be substantially perpendicular to one another. The axis of the portion 30 is substantially horizontal and parallel to the bottom sole 60 of the putter head 22. The axis of the intermediate upwardly-inclined secondary aiming portion 32 is disposed at an acute angle of approximately 60 degrees relatively to the axis of the lower primary aiming portion 30 and has a curved rounded junction 64 therewith. The upper end of the intermediate secondary aiming portion 32 has a rounded junction or connection 66 with the upper substantially vertical portion 34 so that the axes thereof subtend an obtuse angle which places the upper vertical shaft portion 34 substantially in vertical alignment with the rearward face 42 of the putter head 22 (FIG. 3). The lower intermediate and upper shaft portions 30, 32 and 34 lie in a common plane substantially perpendicular to the front face 40 of the putter head 22.

In the use of the putter 10, assuming the golfer G to be right-handed, he takes the stance shown in FIG. 1 with the inner edge of his left shoe 20 parallel to the aiming line or intended trajectory 15 of the ball 12 toward the cup and places his right shoe behind and to one side of his left shoe so as to be out of the way of the arc of swing of the putter 10. This is a stance permitted by the rules of golf. He then grasps the handle 26 with both hands and fingers in the usual way with his thumbs pressing against the flat forward side 38 of the handle 26, to turn the head 22 until the front face 40 is substantially perpendicular to the line of trajectory or aim line 15. At the same time he glances downward and aims the horizontal lower aiming portion 30 of the shaft 24 along the line of trajectory 15 and then lines up therewith the upper intermediate aiming portion 32 with the lower aiming portion 30, analogous to lining up the forward and rearward sights of a rifle with a target. He then swings the putter 10 forward along the line of trajectory 15, whereupon the impact of the head face 40 with the ball 12 propels the latter over the putting green and along the intended trajectory or aim line 15. It will be understood that the aiming line or trajectory 15 adjacent the point of impact with the ball 12 is not necessarily a straight line to the cup but may be a curved line to compensate for an inclined or undulating surface of the particular putting green toward the cup.

I claim:

1. An aim-assisting golf putter, comprising an inverted T-shaped putter head having an upstanding central neck portion and also having a forward face with a substantially flat central ball-impact area thereon, an upstanding putter shaft having at its lower end a lowermost head connection portion secured to and rinsing from said central neck portion of said head above said central ball impact area and having an upper end disposed in close proximity to said head, said shaft having a central substantially horizontal ball-aiming lower portion connected to said upper end of said head connection portion and projecting forward therefrom beyond said head with a forward end disposed forward of said ball impact area in forwardly-spaced relationship thereto, said shaft having an upwardly-directed rearwardly-inclined intermediate portion with a lower end connected to said forward end of said lower portion and with an upper end disposed remote therefrom, said shaft having a substantially vertical upper portion connected to and rising from said upper end of said intermediate portion, and an elongated substantially vertical handle connected to and rising from said upper portion of said shaft, said lower shaft portion and said intermediate shaft portion being disposed in a substantially vertical plane perpendicular to and intersecting said ball-impact area, whereby said plane is substantially coincident with the intended trajectory of the ball to the cup.

2. An aim-assisting golf putter, according to claim 1, wherein said upper shaft portion is also disposed in said substantially vertical substantially perpendicular plane.

3. An aim-assisting golf putter, according to claim 1, wherein said upper shaft portion is substantially aligned with a portion of said head disposed rearward of said ball impact area.

4. An aim-assisting golf putter, according to claim 3, wherein said head has a rearward face spaced rearward away from said forward face, and wherein said upper portion of said shaft is substantially aligned with said rearward face.

* * * * *